US006435863B2

(12) United States Patent
Damrath et al.

(10) Patent No.: US 6,435,863 B2
(45) Date of Patent: Aug. 20, 2002

(54) GAS BURNER FOR COOKING AREAS

(75) Inventors: Joachim Damrath, Bachhagel; Dieter Brunner, Gaggenau; Martin Kornberger, Baden-Baden, all of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/777,442

(22) Filed: Feb. 6, 2001

Related U.S. Application Data

(63) Continuation of application No. PCT/EP99/05713, filed on Aug. 6, 1999.

(30) Foreign Application Priority Data

Aug. 6, 1998 (DE) ..... 198 35 623

(51) Int. Cl.[7] ..... F23D 14/62; F23D 14/06; F23D 14/84

(52) U.S. Cl. ..... 431/354; 431/168; 431/185; 431/186; 126/39 E

(58) Field of Search ..... 431/354, 168, 431/144, 146, 8, 173, 174, 185, 186; 126/39 R, 40, 39 E, 39 H; 239/399

(56) References Cited

U.S. PATENT DOCUMENTS 2,646,788 A * 7/1953 Locke ..... 126/39 H
4,938,687 A * 7/1990 Monteil ..... 126/39 R
6,146,132 A * 11/2000 Harneit ..... 431/354

FOREIGN PATENT DOCUMENTS

| | | | |
|---|---|---|---|
| DE | 88 484 | | 1/1896 |
| DE | 300 031 | | 3/1916 |
| EP | 0 415 049 A | * | 7/1990 |
| FR | 1 535 256 A | * | 6/1968 |

* cited by examiner

*Primary Examiner*—Henry Bennett
*Assistant Examiner*—Josiah C. Cocks
(74) *Attorney, Agent, or Firm*—Laurence A. Greenberg; Werner H. Stemer; Ralph E. Locher

(57) ABSTRACT

A gas burner for cooking areas includes a lower part and an upper part. The upper part has gas repulsion ducts with gas outlet openings for gas flames. The upper part is rotatably mounted on the lower part by a compressed-air bearing configured to apply a compressed-air cushion to pneumatically lift the upper part off the lower part for allowing contactless turning of the upper part in relation to the lower part about an axis of rotation. The gas repulsion ducts are formed to drive the upper part in relation to the lower part about the axis of rotation by gas flowing through the gas repulsion ducts at positive pressure. Such a configuration makes it possible to evenly distribute the heat of the flames in the periphery of the burner and to minimize minimum gas burner output by using less flames.

14 Claims, 2 Drawing Sheets

GAS BURNER FOR COOKING AREAS

CROSS-REFERENCE TO RELATED APPLICATION

This application is a continuation of copending International Application No. PCT/EP99/05713, filed Aug. 6, 1999, which designated the United States.

BACKGROUND OF THE INVENTION

Field of the Invention

The invention lies in the field of household appliances. The invention relates to a gas burner for cooking areas.

A gas burner is disclosed in European Patent EP 0 415 049 B1. The burner includes a lower part seated on an upper part and in which gas outlet openings for gas flames are formed. Connected centrally to the underside of the lower part is a feed pipe for the feeding of combustion gas and primary air.

Prior art gas burners on the market produce a static flame pattern. The minimum output that can be set is relatively high and is concentrated on small areas in the region of the flames. Such concentration often leads to food burning in a pot that is standing on the gas burner, even when the minimum output is set. The gas flames cannot be made unlimitedly as small as desired, but instead go out below a minimum size, required for maintaining the burning state.

U.S. Pat. No. 2,646,788 discloses a gas burner in which the upper part can rotate on the lower part. An additional drive mechanism is required for the driving of the upper part. French Patent No. FR 1 535 256 A describes a gas burner in which the upper part is mounted in the lower part by a perpendicularly disposed spindle. The upper part is able to rotate on the lower part due to horizontally disposed gas outlet openings. The disadvantages of these solutions are not only very complex constructions, in particular, in the case of the mounting or the drive in the U.S. specification, but also that they aim for a maximum burner output, which is based on a better surface area distribution. Such distribution is not possible with these solutions to minimize the burner output, for example, when keeping food warm.

SUMMARY OF THE INVENTION

It is accordingly an object of the invention to provide a gas burner for cooking areas that overcomes the hereinaforementioned disadvantages of the heretofore-known devices of this general type and that distributes the heat of a gas burner over as large a surface area as possible, in particular, when set to the minimum output. Furthermore, the invention is intended to provide a possible way of further minimizing the smallest possible output of gas burners.

With the foregoing and other objects in view, there is provided, in accordance with the invention, a gas burner for cooking areas, including a lower part, and an upper part having gas repulsion ducts with gas outlet openings for gas flames, the upper part rotatably mounted on the lower part by a compressed-air bearing configured to apply a compressed-air cushion to pneumatically lift the upper part off the lower part for allowing contactless turning of the upper part in relation to the lower part about an axis of rotation, the gas repulsion ducts being formed to drive the upper part in relation to the lower part about the axis of rotation by gas flowing through the gas repulsion ducts at positive pressure.

The gas burner according to the invention has the advantages that it distributes the heat produced by its gas flames under a pot or other utensil more evenly over a larger surface area than the prior art gas burners, in particular, when set to the minimum output (gas burner set to the smallest possible flame size), and that it can be set to a smaller minimum output than prior art gas burners.

The gas burner according to the invention is preferably configured such that, when set to the minimum output, only a very small number of individual gas flames are produced. According to the invention, only one to five individual gas flames are preferably provided. These gas flames are set in rotation at low speed, preferably in the range between 20 and 100 rpm. Such rotation achieves the effect that, because of the reduced number of gas flames, the overall output of the burner is reduced, although the length of the individual flame may well be greater than in the case of prior art gas burners. The rotation has the effect that the heat is evenly distributed under a pot or other utensil that is standing on the gas burner.

In accordance with another feature of the invention, the axis of rotation is a vertical axis of rotation.

In accordance with a further feature of the invention, the gas repulsion ducts are formed to drive the upper part in relation to the lower part in a circumferential direction.

In accordance with an added feature of the invention, the gas repulsion ducts are curved and have side walls pointing in a circumferential direction to be driven by the gas flowing at positive pressure about the axis of rotation.

In accordance with an additional feature of the invention, the gas repulsion ducts are turbine blade-shaped.

In accordance with yet another feature of the invention, the upper part has an outer circumference, the gas repulsion ducts have downstream end portions with gas outlet openings at the outer circumference, and the openings are directed in a circumferential direction and counter to a direction of rotation of the upper part to produce a gas repulsion from emerging gas for driving the upper part about the axis of rotation.

In accordance with yet an added feature of the invention, the gas repulsion ducts open downward toward the lower part, the upper part has lands between the gas repulsion ducts, and the lands are configured to support the upper part on the lower part.

In accordance with yet an additional feature of the invention, the gas repulsion ducts form the compressed-air bearing.

In accordance with again another feature of the invention, the gas repulsion ducts have radially inner, upstream beginnings and downstream ends with gas outlet openings for gas flames, and including a duct disposed in or in a vicinity of the axis of rotation for feeding one of combustion gas and a mixture of combustion gas and air, the duct fluidically connected to the beginnings.

In accordance with again an added feature of the invention, the gas outlet openings are disposed in a horizontal plane, the gas repulsion ducts have downstream outlets disposed in another horizontal plane, the gas repulsion ducts have upstream portions, and including a duct for feeding one of combustion gas and a mixture of combustion gas and air, and another duct for feeding air at a positive pressure with respect to the surroundings, the gas outlet openings being fluidically connected with the duct and the upstream portions being fluidically connected with the another duct.

In accordance with again an additional feature of the invention, there is provided a compressed-air source for feeding air at a pressure above atmospheric pressure to the gas repulsion ducts.

In accordance with a concomitant feature of the invention, the upper part has an increasingly reduced diameter in a downward direction at a region of the gas repulsion ducts, the lower part has a depression having another increasingly reduced diameter in the downward direction matched to the diameter, and the region protrudes into the depression.

Other features that are considered as characteristic for the invention are set forth in the appended claims.

Although the invention is illustrated and described herein as embodied in a gas burner for cooking areas, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 3:
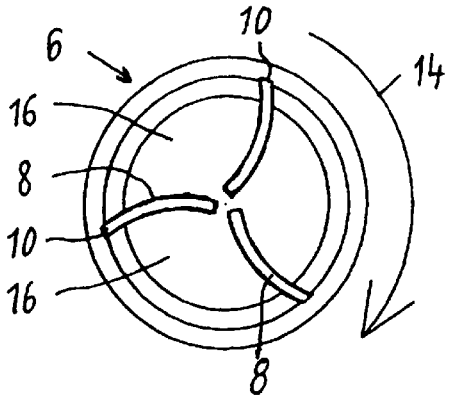
FIG. 3 is a bottom plan view of the upper part of the gas burner of FIGS. 1 and 2.

In all the figures of the drawing, sub-features and integral parts that correspond to one another bear the same reference symbol in each case.

Figure 1:
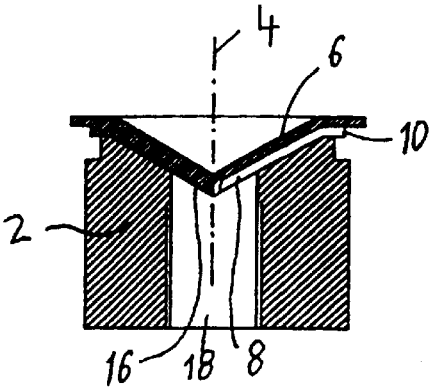
FIG. 1 is a cross-sectional view through a lower part and an upper part seated on the lower part of a gas burner according to the invention in a switched-off state.
Figure 2:
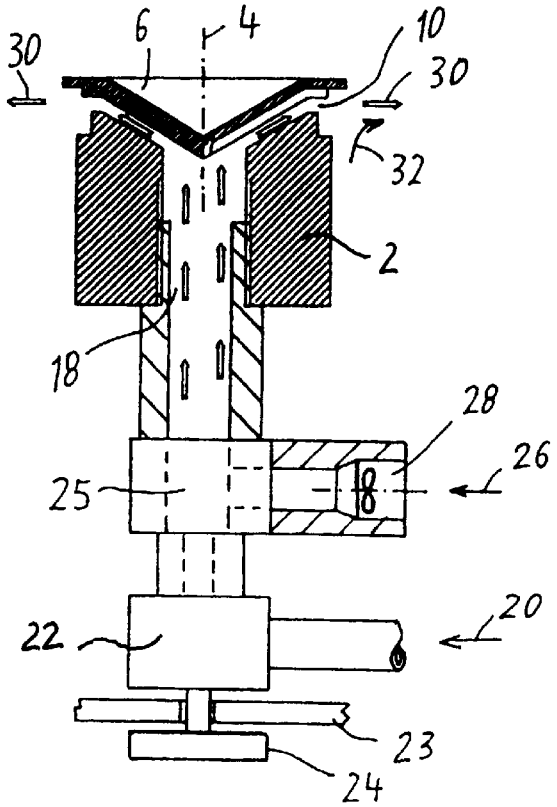
FIG. 2 is a cross-sectional view through the gas burner of FIG. 1 in a switched-on state.

Referring now to the figures of the drawings in detail and first, particularly to FIGS. 1, 2, and 3 thereof, there is shown a gas burner according to the invention for cooking areas having a lower part 2 and an upper part 6 (burner cover) rotatably disposed about a vertical axis of rotation 4. On the underside of the upper part 6 gas repulsion ducts 8 are formed such that the upper part 6 can be driven in relation to the lower part 2 in the circumferential direction about the axis of rotation 4 by high-pressure gas that flows essentially radially outward from the vicinity of the axis of rotation 4 through the gas repulsion ducts 8 and, at the downstream ends of which, leaves from gas outlet openings 10. The gas can be ignited at the openings 10 to form gas flames.

As the view from below of the upper part 6 in FIG. 3 shows, the gas repulsion ducts 8 have a curved shape and side walls pointing in the circumferential direction in the manner of turbine blades, so that they can be driven by the gas flowing at positive pressure about the axis of rotation 4 in the direction of an arrow 14. The gas repulsion ducts 8 need not be limited to the shape shown in the figures.

At the outer circumference of the upper part 6, the downstream end portions of the gas repulsion ducts 8 and their gas outlet openings 10 are directed in the circumferential direction counter to the direction of rotation 14, preferably approximately tangentially, in order that gas emerging from the gas outlet openings 10 drives the upper part 6 about the axis of rotation 4 (repulsion effect).

The gas repulsion ducts 8 formed in the upper part 6 are open downward toward the lower part 2 and the lands 16 between the gas repulsion ducts 8 can be placed on the lower part 2 to support the upper part on the lower part.

The mixture of combustion gas and primary air flowing through the gas repulsion ducts 8 is at such a high pressure that it can lift the upper part 6 off the lower part 2 by a few tenths of a millimeter or a few millimeters and turn it about the axis of rotation 4. The mixture of combustion gas and primary air under positive pressure forms between the upper part a-d the lower part a gas cushion, on which the upper part 6 rotates contactlessly on the lower part 2. Consequently, he gas repulsion ducts 8 form a compressed-air bearing. FIG. 1 shows the lower and upper parts 2, 6 in a switched-off state, and FIG. 2 shows the parts 2, 6 in a switched-on state.

The radially inner, upstream ends of the gas repulsion ducts 8 are located above a vertical duct 18 axially disposed with respect to the axis of rotation 4. The duct 18 can be fed combustion gas 20 through a gas tap 22 that is capable of being opened and closed to a greater or lesser extent by an operating element 24 on an operating panel of a gas cooker, and through a mixing chamber 25. At the same time, primary air 26 is fed by a blower 28 through the mixing chamber 25 at approximately the same pressure as the combustion gas 20 to the central duct 18. The gas flames 30 of the mixture of combustion gas and primary air can induct secondary air 32 from their surroundings to improve the combustion.

The rotation of the upper part 6 in relation to the non-rotating lower part 2 and the individual gas flames 30 are produced in the following way. Under the gas burner, the combustion gas 20 and the primary air 26 are mixed with the primary air 26 being fed to the mixing chamber 25 at approximately the same pressure as the combustion gas 20. The pressure for the primary air 26 can be generated by the blower 28 or another suitable device and, if appropriate, can be set.

The mixture of combustion gas and primary air flows to the burner head, made of the lower part 2 and the upper part 6, where it lifts the upper part 6 (burner cover) slightly off the lower part 2, so that the upper part 6 is floating on the gas-air cushion.

The upper part 6 has on its underside grooves that form the gas repulsion ducts 8. After the mixture of combustion gas and air has been formed, the tangentially deflected gas streams form individual flames 30 that rotate about the axis of rotation 4.

At settings to relatively great burner outputs and at full burn, the rotating upper part 6 (burner cover) lifts off further from the lower part, so that a closed flame ring can form.

Depending on the form and shape of the gas repulsion ducts 8, the upper part 6 is driven for rotation about the axis of rotation 4 only by the repulsion of the gases flowing out of them downstream and/or by the gas acting in a turbine-like manner on the side walls of the gas repulsion ducts.

Figure 6:
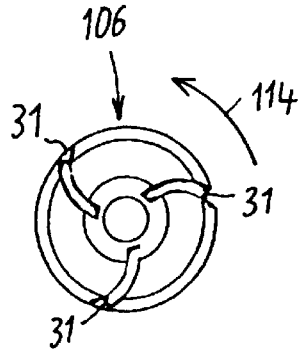
FIG. 6 is a bottom plan view of the upper part of the gas burner of FIGS. 4 and 5.
Figure 4:
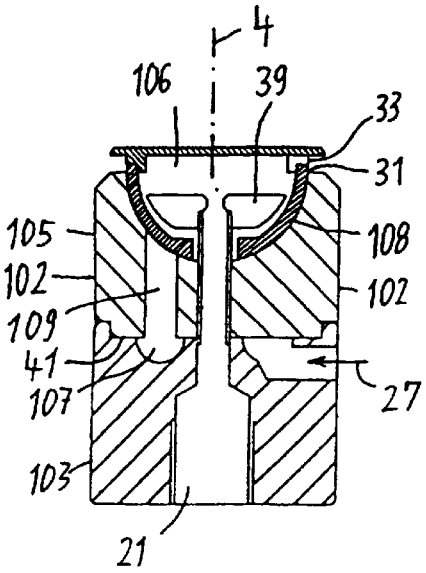
FIG. 4 is a cross-sectional view through a lower part and an upper part seated on the lower part of a further embodiment of a gas burner according to the invention in a switched-off state.
Figure 5:
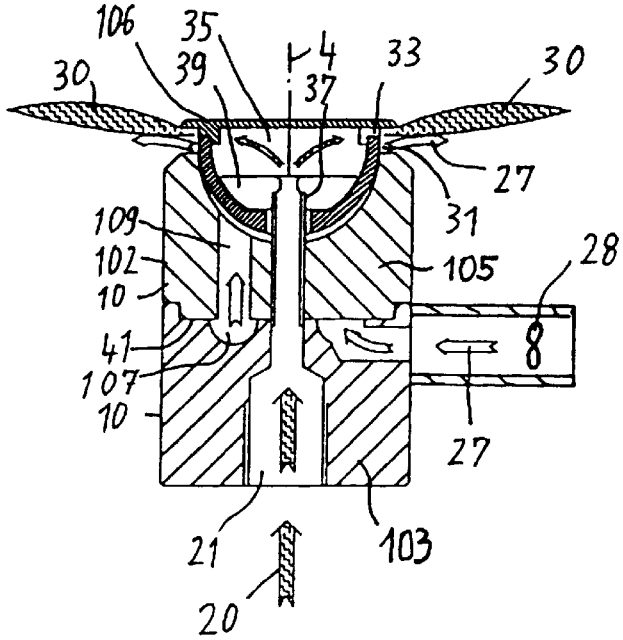
FIG. 5 is a cross-sectional view through the gas burner of FIG. 4 in a switched-on state.

In the further embodiment according to FIGS. 4, 5 and 6, the same principle is applied as in the embodiment according to FIGS. 1, 2 and 3, but with the difference that only air at positive pressure is fed to the gas repulsion ducts, without combustion gas, or with only a small proportion of combustion gas, and that the combustion gas is fed to separate gas outlet openings, at which the gas flames are ignited. FIG. 4 shows the lower and upper parts 102, 106 in a switched-off state, and FIG. 5 shows the parts 102, 106 in a switched-on state.

In FIGS. 4, 5, and 6, an upper part 106 is rotatably disposed about a vertical axis of rotation 4 on a lower part 102. Gas repulsion ducts 108 are formed in the upper part 106 such that compressed air 27 flowing through them at positive pressure turns the upper part 106 in relation to the lower part 102 about the axis of rotation 4. The lower part 102 is disposed in a non-rotating manner.

According to FIG. 6, the gas repulsion ducts 108 have a curved shape and side walls pointing in the circumferential direction in the manner of turbine blades. The gas repulsion ducts 8 need not be limited to the shape shown in the figures, so long as the compressed air flowing along the ducts 108 at positive pressure drives the ducts 108 about the axis of rotation 4. At the outer circumference of the upper part 106, where the ducts 108 have their air outlet openings 31, the downstream end portions of the gas repulsion ducts 108 are directed approximately tangentially in the circumferential direction counter to the direction of rotation 114, so that compressed air leaving them drives the upper part 106 about the axis of rotation 14 in relation to the non-rotating lower part 102 by a repulsion effect.

In the cross-section shown in FIGS. 4 and 5, the upper part 106 has on its underside, in the region of its gas repulsion ducts 108, a lower hemisphere form. The hemisphere region protrudes into a matching hemispherical recess of the lower part 102.

The hemisphere region of the upper part 106 is hollow. The hollow space 35 is provided at the upper end, directly above the air outlet openings 31 for compressed air 27 of the gas repulsion ducts 108. The hollow space 35 has gas outlet openings 33 for combustion gas 20 or a mixture of combustion gas and primary air for forming at least one individual gas flame 30. The compressed air of the air outlet openings 31 can be fed as secondary air to the gas flames 30. The air outlet openings 31, configured in a ring, lie in a horizontal plane located below another horizontal plane in which the gas outlet openings 33 are configure in a ring.

The combustion air 20 or a mixture of combustion air 20 and primary air (corresponding to primary air 26 from FIG. 2) is fed to the hollow space 35 of the upper part 106 through a pipe 37 that is disposed axially with respect to the axis of rotation 4. The pipe 37 is connected to the lower part 102 and protrudes into the hollow space 35. The pipe 37 is provided in the hollow space 35 with stops 39 that limit the vertical lifting-off distance of the upper part 106 from the lower part 102.

According to FIGS. 4 and 5, the lower part 102 may include a lower body 103 and an upper body 105. In this case, it is expedient to pass the compressed air 27 from a compressed-air source 28, for example, a blower, in the separating plane 41 through an annular duct 107 around the axis of rotation 4 to an axially parallel air duct 109 and from the air duct 109 into the hollow space 35. Consequently, the compressed air 27 forms a "seal" in the separating plane 41 for sealing off combustion gas that is flowing from an axial duct 21 in the lower body 103 into the pipe 37.

In the embodiment according to FIGS. 4, 5 and 6, only a compressed-air stream lifts the upper part 106. A small part of the compressed-air stream serves in the separating plane 41 for sealing off with respect to the combustion gas 20 and, if appropriate, can also be admixed with the combustion gas 20 as primary air, for example, through a gap in the separating plane 41. The other, far greater part of the compressed air 27 serves not only for lifting and rotating the upper part 106 (burner cover) but also for supplying the gas flames 30 with secondary air. One particular advantage of the embodiment is that the lifting and the rotational speed of the upper part 106 are independent of the amount of combustion gas fed per unit of time and can be set or controlled independently of the combustion gas. The compressed air 27 is intended for lifting and rotating the upper part 106 and can be used as secondary air independent of the geometry of the cooktop formed by the gas burner.

The "gas- or air-cushion bearing" can, according to another embodiment, be configured as a hydrostatic bearing or hydrodynamic bearing, as are disclosed in the prior art for other technical fields.

We claim:

1. A gas burner for cooking areas, comprising:

a lower part; and an upper part having gas repulsion ducts with gas outlet openings for gas flames, said upper part rotatably mounted on said lower part by a compressed-air bearing configured to apply a compressed-air cushion to pneumatically lift said upper part off said lower part for allowing contactless turning of said upper part in relation to said lower part about an axis of rotation, said gas repulsion ducts being formed to drive said upper part in relation to said lower part about said axis of rotation by gas flowing through said gas repulsion ducts at positive pressure.

2. The gas burner according to claim 1, wherein axis of rotation is a vertical axis of rotation.

3. The gas burner according to claim 1, wherein said gas repulsion ducts are formed to drive said upper part in relation to said lower part in a circumferential direction.

4. The gas burner according to claim 1, wherein said gas repulsion ducts are curved and have side walls pointing in a circumferential direction to be driven by the gas flowing at positive pressure about said axis of rotation.

5. The gas burner according to claim 4, wherein said gas repulsion ducts are turbine blade-shaped.

6. The gas burner according to claim 1, wherein said upper part has an outer circumference, said gas repulsion ducts have downstream end portions with gas outlet openings at said outer circumference, and said openings are directed in a circumferential direction and counter to a direction of rotation of said upper part to produce a gas repulsion from emerging gas for driving said upper part about said axis of rotation.

7. The gas burner according to claim 4, wherein said upper part has an outer circumference, said gas repulsion ducts have downstream end portions with gas outlet openings at said outer circumference, and said openings are directed in said circumferential direction and counter to a direction of rotation of said upper part to produce a gas repulsion from emerging gas for driving said upper part about said axis of rotation.

8. The gas burner according to claim 1, wherein said gas repulsion ducts open downward toward said lower part, said upper part has lands between said gas repulsion ducts, and said lands are configured to support said upper part on said lower part.

9. The gas burner according to claim 8, wherein said gas repulsion ducts form said compressed-air bearing.

10. The gas burner according to claim 1, wherein said gas repulsion ducts have radially inner, upstream beginnings and downstream ends with gas outlet openings for gas flames, and including a duct disposed in said axis of rotation for feeding one of combustion gas and a mixture of combustion gas and air, said duct fluidically connected to said beginnings.

11. The gas burner according to claim 1, wherein said gas repulsion ducts have radially inner, upstream beginnings and downstream ends with gas outlet openings for gas flames, and including a duct disposed in a vicinity of said axis of rotation for feeding one of combustion gas and a mixture of combustion gas and air, said duct fluidically connected to said beginnings.

12. The gas burner according to claim 1, wherein said gas outlet openings are disposed in a horizontal plane, said gas repulsion ducts have downstream outlets disposed in another horizontal plane, said gas repulsion ducts have upstream portions, and including a duct for feeding one of combustion gas and a mixture of combustion gas and air, and another duct for feeding air at a positive pressure with respect to the surroundings, said gas outlet openings being fluidically connected with said duct and said upstream portions being fluidically connected with said another duct.

13. The gas burner according to claim 1, including a compressed-air source for feeding air at a pressure above atmospheric pressure to said gas repulsion ducts.

14. The gas burner according to claim 1, wherein said upper part has an increasingly reduced diameter in a downward direction at a region of said gas repulsion ducts, said lower part has a depression having another increasingly reduced diameter in the downward direction matched to said diameter, and said region protrudes into said depression.

* * * * *